United States Patent [19]

Whitener, Jr. et al.

[11] Patent Number: 4,744,227

[45] Date of Patent: May 17, 1988

[54] PATTERN MONITORING METHOD AND APPARATUS

[76] Inventors: Charles G. Whitener, Jr.; Gary Hibbard, both of 1465C Howell Mill Rd., Atlanta, Ga. 30318

[21] Appl. No.: 65,517

[22] Filed: Jun. 23, 1987

[51] Int. Cl.[4] ..... D04B 35/12

[52] U.S. Cl. ..... 66/163

[58] Field of Search ..... 66/157, 163; 200/61.13

[56] References Cited

U.S. PATENT DOCUMENTS

| | | | |
|---|---|---|---|
| 3,688,958 | 9/1972 | Rydborn | 66/163 X |
| 3,961,500 | 6/1976 | Braley et al. | 66/210 |
| 4,267,554 | 5/1981 | Loepfe et al. | 66/163 |
| 4,430,870 | 2/1984 | Winter | 66/210 |
| 4,455,549 | 6/1984 | Rydborn | 66/163 X |
| 4,628,710 | 12/1986 | Jacobsson | 66/163 X |

*Primary Examiner*—Ronald Feldbaum
*Attorney, Agent, or Firm*—James B. Middleton

[57] ABSTRACT

A pattern monitoring method and apparatus wherein the movements of each individual yarn are detected and recorded. A piece of textile goods is produced, and all the yarn movements for making that piece are recorded, that record being then used as a standard. Additional pieces are made, and the yarn movements during the making of the additional pieces are detected and similarly recorded. The movements may, immediately or eventually be compared to the standard. An error signal is given when there is no match; however, an allowable error can be selected so that the error signal is given only when the error is greater than the selected allowable error. The error signal can be a light, or may be a stop motion device.

12 Claims, 3 Drawing Sheets

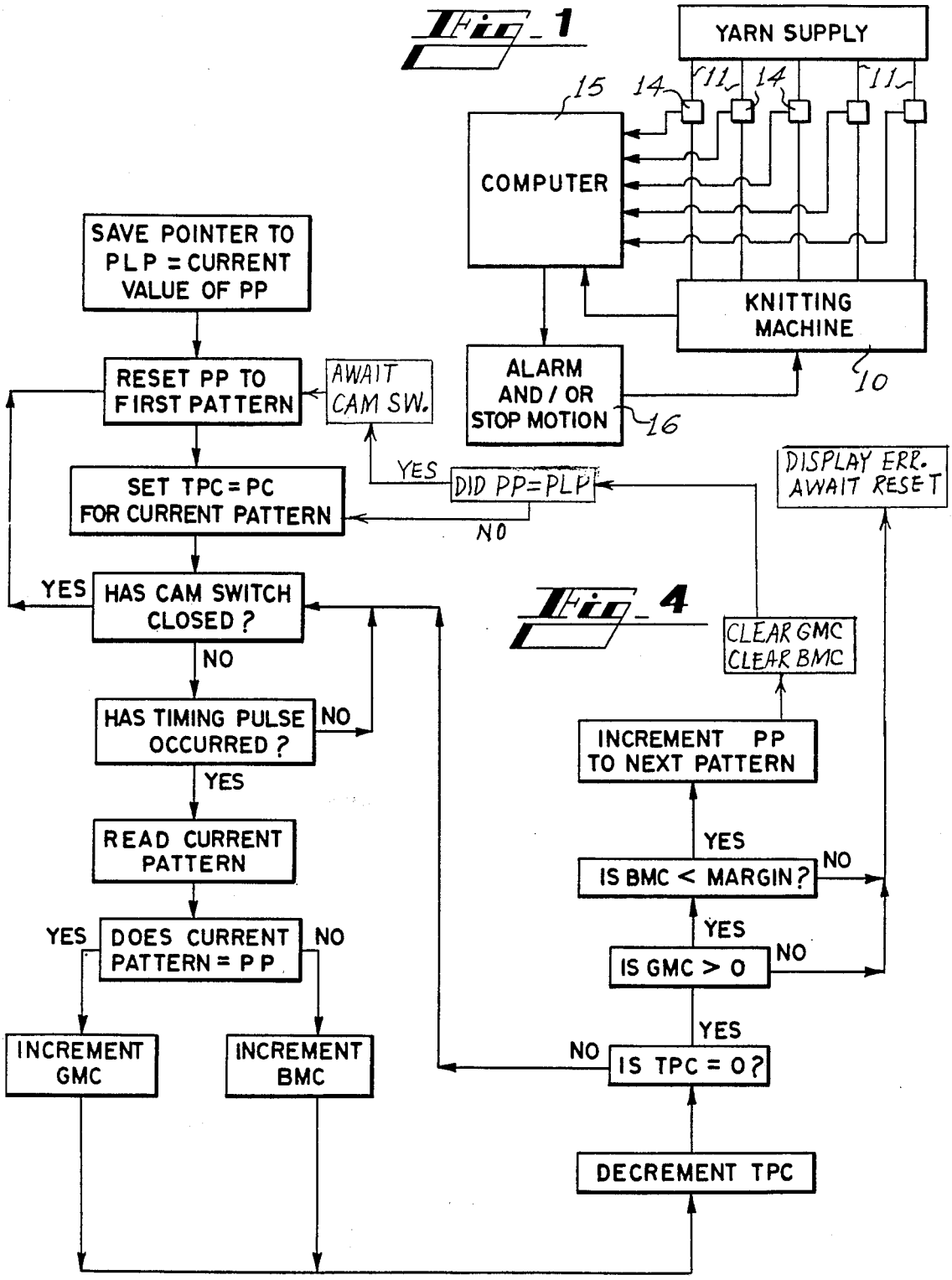
Fig. 1
YARN SUPPLY
15
14
11
14
11
COMPUTER
KNITTING MACHINE
10
ALARM AND / OR STOP MOTION
16
SAVE POINTER TO PLP = CURRENT VALUE OF PP
RESET PP TO FIRST PATTERN
AWAIT CAM SW.
SET TPC = PC FOR CURRENT PATTERN
YES
DID PP=PLP
NO
DISPLAY ERR. AWAIT RESET
YES
HAS CAM SWITCH CLOSED ?
NO
Fig. 4
CLEAR GMC CLEAR BMC
HAS TIMING PULSE OCCURRED ?
NO
YES
INCREMENT PP TO NEXT PATTERN
READ CURRENT PATTERN
YES
IS BMC < MARGIN?
NO
YES
DOES CURRENT PATTERN = PP
NO
YES
IS GMC > 0
NO
INCREMENT GMC
INCREMENT BMC
NO
YES
IS TPC = 0?
DECREMENT TPC 25
26
21
KEYED SWITCH
22
RESET CIRCUIT
RS-485
24
29
OPTO-ISOLATOR
MCU AND DECODER
15
18
38
RAM
19
20
ROM
28
CAM SWITCH ON KNITTER
34
LATCH
OPTO-ISOLATOR
8-BIT COUNTER
32
PUSHBUTTONS AND DISPLAY
49
RELAY
31
OPTO-ISOLATOR
16
STOP OUTPUT
30
LATCH
41
40
OPTO-ISOLATOR
OPTO-ISOLATOR
RELAY
42
8 YARN SENSORS
14
8 LED'S
16
LAMP OUTPUT
8 LED'S
48
46
CURRENT DRIVERS
45
OPTO-ISOLATOR
LATCH
44
35

PATTERN MONITORING METHOD AND APPARATUS

INFORMATION DISCLOSURE STATEMENT

In the textile industry, there are several situations in which a particular pattern is produced, as by knitting, and the pattern is to be repeated a plurality of times. In such apparatus, it is known in the art to utilize stop motion means, the stop motion means commonly being utilized to monitor the presence of a yarn. Thus, if the yarn breaks, or the supply is exhausted, the yarn is no longer present and the stop motion means will cause operation of the knitting machine to stop.

While the stop motion means is effective in detecting the one type of problem, there are numerous situations in which the conventional stop motion means is not adequate to prevent the manufacture of defective goods. For example, the yarn may be broken, but held so that the yarn is continuous through the stop motion device. Also, the yarns may be in place, but there may be a defect in the apparatus that causes improper feeding of the yarns. In either event, the apparatus continues to operate as if normal, but the goods produced are defective, and must be discarded. The only conventional means for detecting such defective goods is a visual inspection. Thus, as the textile industry attempts to utilize fewer employees with greater automation, there is a greater liklihood for the production of unusable goods.

SUMMARY OF THE INVENTION

This invention relates generally to pattern monitoring means, and is more particularly concerned with a method and apparatus whereby the movement of yarns for providing a predetermined pattern is stored; and, the stored information may be compared against current yarn movement to determine if the current pattern is correct.

The present invention provides a monitoring system including a plurality of yarn motion sensors. During the creation of one pattern, the yarn motions are monitored, and the motions are stored to provide a standard pattern. Subsequently, as a pattern is produced, the motions of the yarns are compared against the motions for the standard pattern. If a yarn moves when it ought not to move, or fails to move when it ought to move, signalling means can be activated either to signal an operator or stop the machine. An acceptable range of error, or margin, may be included to allow a selected amount of variation from the standard pattern.

BRIEF DESCRIPTION OF THE DRAWINGS

These and other features and advantages of the present invention will become apparent from consideration of the following specification when taken in conjunction with the accompanying drawings in which:

FIG. 1 is a schematic illustration showing the overall apparatus made in accordance with the present invention;

DETAILED DESCRIPTION OF THE EMBODIMENT

Figure 2:
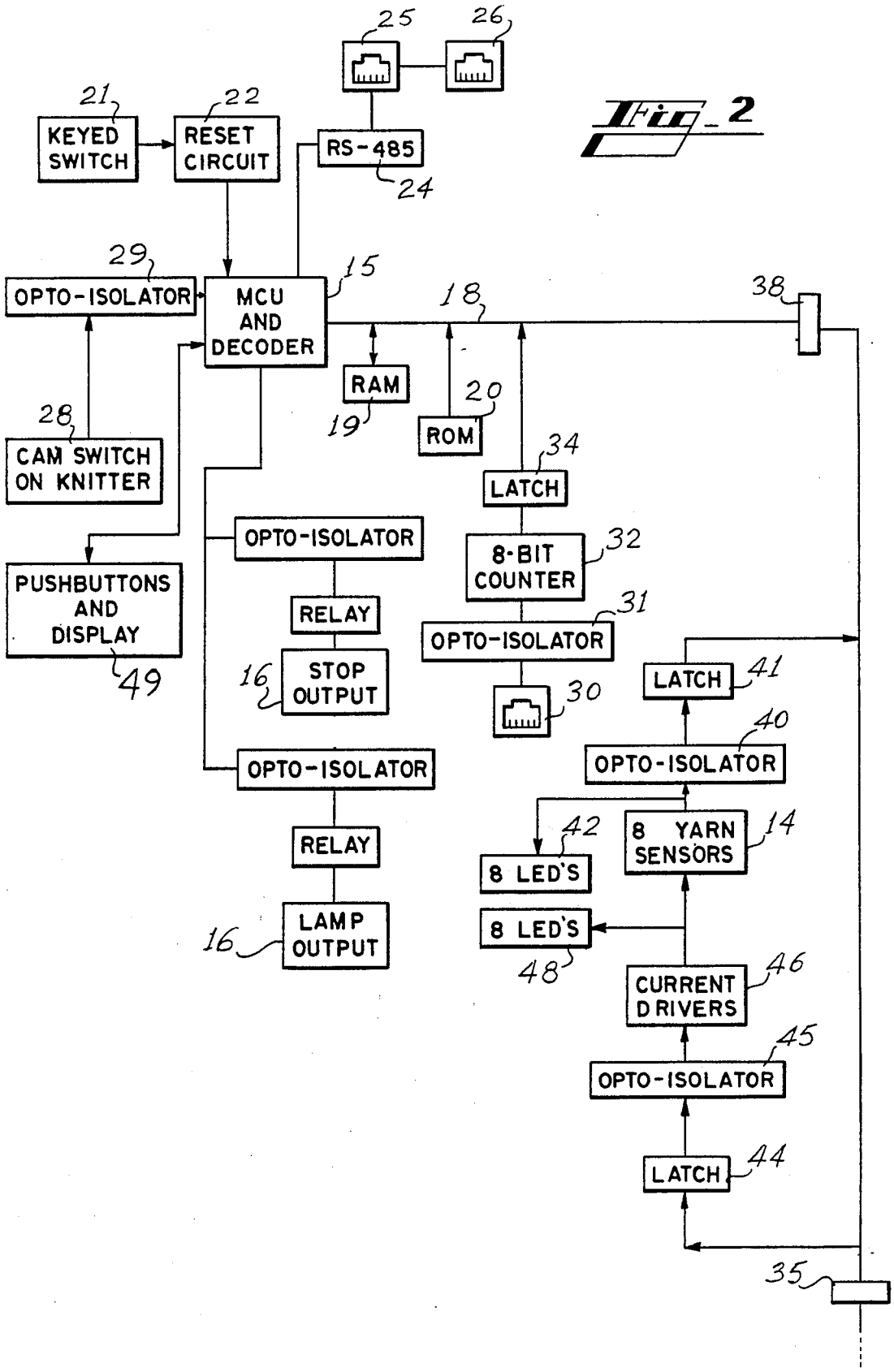
FIG. 2 is a block diagram illustrating one form of apparatus made in accordance with the present invention.

Referring now more particularly to the drawings, and to that embodiment of the invention here presented by way of illustration, FIG. 1 shows a knitting machine 10 by way of example. It will be understood that any machine having yarn usage in fixed patterns may be utilized with the present invention, but one application is in the use of a knitting machine wherein a plurality of yarns 11 is utilized to knit a sock or the like. The knitting machine 10 receives the plurality of yarns 11 from a creel 12 or other yarn supply. This arrangement is well known to those skilled in the art, and no detailed description is throught to be necessary.

In conjunction with each of the yarns 11, there is a yarn motion monitoring means 14. When the monitoring means 14 detects motion of a yarn 11, a signal is fed to the computer generally designated at 15.

It will be recognized that the knitting machine 10 may operate at varying speeds; therefore, a signal must be produced by the knitting machine 10 and fed to the computer 15. Since the computer 15 will memorize the signals from the monitoring means 14 as a function of time, a comparable time signal must be fed from the knitting machine 10 so the computer can always reproduce a given yarn length.

In the event a problem is detected by the computer 15, the alarm and/or stop motion means 16 may be activated, and may be utilized to stop the knitting machine.

Referring now to FIG. 2 of the drawings, the computer is illustrated at 15, and the bus 18 is provided with random access memory (RAM) 19 for manipulation of data, and a read only memory (ROM) 20 for storage of programming and the like. It will be understood that various data to be fed to the computer 15 will be placed on the bus 18, and the various apparatus to be operated by the computer 15 will be operated from the bus 18. Though some apparatus is shown as connected directly to the computer 15 rather than to the bus 18, it should be understood that this is for convenience only, and those skilled in the art will understand the provision of signals to and from the computer 15.

For security, there may be provided a key switch 21 for access by only authorized personnel. The switch 21 can operate a reset circuit 22 to reset the computer 15, eliminating all stored patterns so the process can begin at the beginning.

It will also be seen that there is a standard board indicated at 24 for parallelling computers such as the computer 15. There are here shown two modular jacks 25 and 26 indicating means for connecting additional computers 15 in parallel. With this arrangement, several machines can be operated in tandem, or the data can be fed to a mainframe computer for detailed analysis and/or storage if desired.

In operation of the present invention, it will be understood that an indication of the beginning of a pattern is required. In machines such as knitting machines, those skilled in the art will understand that there is a plurality of cams, the cams being used to create, or determine, the particular pattern being knit. One cam on the knitter determines the beginning of a cycle; therefore a switch 28 is placed on this particular cam to provide a signal to the computer 15 indicating that a pattern is being started. Thus, the cam switch indicated at 28 provides a signal at the beginning of each pattern. Because the cam switch may utilize a different voltage and different power from that tolerated by the computer 15, the cam switch 28 is fed through an opto-isolator 29, thence to the computer 15.

The opto-isolator 29 is a conventional piece of apparatus generally including a light source such as a light emitting diode (LED) in conjunction with a phototransistor. The phototransistor can then be operated at the appropriate power and voltage for the computer 15 to prevent damage.

It is inherent in computers that the primary operation is in accordance with time. Thus, as was mentioned briefly in conjunction with FIG. 1 of the drawings, there must be a signal from the knitting machine 10 to the computer 15 to indicate the speed for the knitting machine in order to maintain synchronism in the pattern. In FIG. 2 of the drawings there is a jack 30 which is the input for the timing signal. While many forms of timing signal may be utilized by those skilled in the art, one simple arrangement utilized in the present invention is to place a proximity sensor adjacent to a pulley or the like on the knitting machine. As the bolt heads pass the proximity sensor, a signal will be generated, the plurality of signals yielding an indication of the speed of the knitting machine. The jack 30 may therefore be referred to hereinafter as the proximity input.

As before, there is an opto-isolator 32 to adjust the voltage and power from the proximity input 30 to that required for the computer 15. The opto-isolator provides a signal to the eight-bit counter 31, the information from the counter 32 being stored in a latch 34. Information is then read from the latch 34 by the computer 15 through the bus 18.

It is contemplated that the apparatus of the present invention can be utilized with almost any number of yarns. For convenience in manufacture, the yarn sensors are grouped in groups of 8 sensors, and one group of eight is illustrated in FIG. 2 of the drawings; however, the connector 35 will allow connection of additional groups like the group illustrated in FIG. 2.

It will be seen that the line 36 is connected to the bus 18 through the connector 38. The yarn sensors 14 detect yarn motion, pass a signal through the opto-isolator 40 and place the information in the latch 41. The line 36 then provides means for reading information from the latch 41 into the computer 15. The group of LED's indicated at 42 provides a visual indication of operation or not of the yarn sensors.

Realizing that information from the yarn sensors must be timed, signals are passed to the yarn sensors 14 from line 36, signals being first stored in a latch 44, and passed through opto-isolators 45 to current drivers 46. The current drivers 46 are then connected to the yarn sensors 14, and a bank of LED's 48 illustrates the condition at any given instant.

It will be realized that a pattern will never be repeated precisely, but there will always be some amount of error. A certain amount of error is allowed in the reproduction of a pattern, but there must be some threshhold beyond which the pattern will be considered as a reject. This threshhold is rather variable, depending on individual standards, types of goods, etc. Therefore, the computer programming preferably allows selection of the accepted variance from the preferred or standard pattern.

The particular error, or margin, can be varied by the user through manipulation of the pushbuttons 49, the "display" indicating the margin set for repeatability.

Figure 3:
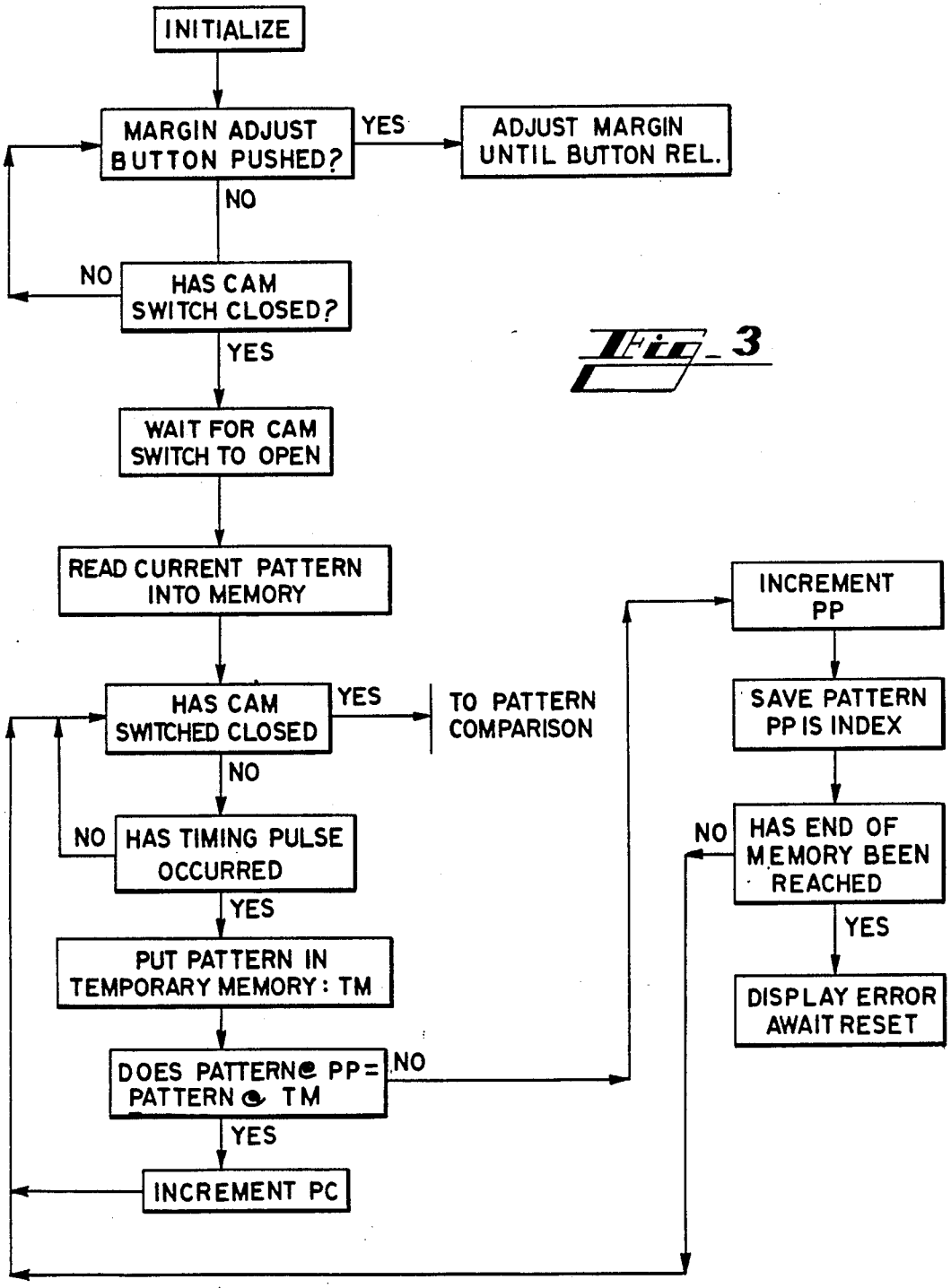
FIG. 3 is a flow chart showing the steps in recording a standard pattern in accordance with the present invention; and, FIG. 4 is a flow chart showing the comparison of a current pattern with the standard pattern.

With the above description in mind, it should now be understood that the use of the apparatus requires that a pattern be produced and memorized. Thus, referring to FIG. 3 of the drawings it will be seen that the system is initialized, and the first inquiry is whether or not a margin adjust button is being pushed. It the answer is "yes", the margin is adjusted up or down, and the adjustment of the margin is displayed. Once the margin has been properly adjusted and the button released, the answer will be "no" so that the next inquiry is whether or not the cam switch has closed. The cam switch 28 indicates the beginning of a cycle, so the memorizing of a pattern ought not to be started until the cam switch has closed indicating the beginning of the pattern. Thus, if the inquiry results in a "no", there is a loop back to the earlier inquiry.

Once the cam switch 28 closes, the opening of the cam switch will initiate the pattern, so the system waits for the cam switch to open. Once the cam switch opens, the pattern is fed into memory.

From the reading into memory, the next inquiry is whether or not the cam switch has once again closed. This will indicate the end of the pattern, so that a "yes" answer allows the system to look to the pattern comparison while a "no" answer directs the system to the inquiry as to whether or not a timing pulse has occurred. If there has been no timing pulse, the system returns to the inquiry about the cam switch, while if the timing pulse has occurred the direction is to read the pattern into a temporary memory location (TM). Following the placing of the pattern in temporary memory, the system compares the pattern in temporary memory with the pattern at the pattern pointer (PP) location. If the determination is that the patterns are the same, the system goes to the next step and increments the pattern counter (PC) for this counter, whereas if the patterns do not match, the system increments the pattern pointer. From the incrementing of the pattern pointer, the system saves this pattern in memory utilizing the pattern pointer as an index. Then, there is an inquiry as to whether or not the end of memory has been reached. If the determination is "yes", an error is displayed and the system waits for the reset, whereas if the answer is "no" the system returns to the beginning of a pattern and inquires whether or not the cam switch has closed.

It will therefore be seen that the system can be operated, the knitting machine 10 knitting a pattern, and the pattern will be stored in memory. If there is an error in the course of knitting the first pattern, the system will be reset, and a new pattern will be started. This process will continue until a pattern has been successfully knitted to provide a standard pattern in the memory.

Once there is a standard pattern in memory, subsequent patterns are to be compared to the standard pattern. The comparison system is illustrated in FIG. 4 of the drawings, the first block being connected to the "yes" response in FIG. 3 as indicated.

The first block in FIG. 4 indicates that the system will save the current value of a pattern pointer to the last pattern in the sequence (PLP). Next, the system will reset the pattern pointer to the first pattern. Next, a temporary pattern counter (TPC) is set equal to the pattern counter (PC) for the current pattern being knit. The system next inquires if the cam switch is closed indicating the end of the preceding pattern. If the answer is "yes", the system returns to the step of resetting the pattern pointer, while if the answer is "no" there is an inquiry if a timing pulse has occurred. If the answer is "no", the system returns to the inquiry as to whether the cam switch has closed, while if the answer is "yes" the system continues to read the current pattern.

After reading current pattern, there is an inquiry as to whether the current pattern matches the pattern that the pattern pointer is indicating. If the answer is "yes", the good match counter (GMC) is incremented, whereas if the pattern does not match, the bad match, counter (BMC) is incremented.

After one of the counters, the GMC or the BMC, is incremented, the next step is to decrement the temporary pattern counter. After the TPC is decremented, there is an inquiry as to whether or not the TPC is equal to zero. If it is not, the system returns to the inquiry as to whether the cam switch has closed, and if it is equal to zero there is an inquiry as to whether the GMC is greater than zero. If the response is "yes", the next inquiry is whether or not the BMC is less than the margin. If the answer to this last inquiry is "yes", the pattern pointer is incremented to the next pattern. If the answer to either inquiry is negative, an error is indicated on the display, and the alarm or stop motion 16 will be activated.

Following the incrementing of the pattern pointer to the next pattern, the GMC and the BMC are cleared, and there is then the inquiry as to whether this was the last pattern, which is to say whether the pattern pointer is equal to the last pattern in the sequence (PLP). If the answer is "yes", the system waits for the cam switch to open, then returns to reset the pattern pointer to the first pattern. If the answer as to PLP is "no", the system goes to the step of setting a temporary pattern counter equal to the pattern counter for this pattern.

From the foregoing, it will be readily understood by those skilled in the art that the method and apparatus of the present invention provide for the memorizing of each yarn motion in the appropriate sequence when the desired pattern is prepared. The system can be repeated several times if required in order to record as nearly as possible a perfect pattern to be utilized as a standard. Once the standard pattern is in memory, the knitting machine or other apparatus can be operated at any desired speed, the proximity input 30 providing information so the yarn motions are always taken in accordance with the given machine speed.

Because each motion of each yarn is monitored, the present invention can detect an error when a yarn is in place but not being fed properly into the machine, though the device will also detect the absence of a yarn due to yarn breakage or the like. Furthermore, if some error in the machine causes the feeding of an improper yarn at a given instant, the present invention will also detect that error and allow correction before numerous bad patterns are created.

It will of course be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. In a textile machine wherein textile goods are produced, said textile goods having a predetermined pattern and a plurality of yarns are utilized by said textile machine for producing said pattern in said goods, the combination therewith of means for monitoring movement of each of said plurality of yarns as said yarns are moved for utilization in said textile machine for producing said goods, means for indicating the beginning of a cycle wherein said textile machine begins to produce said one piece of said textile goods, and means for producing a signal indicating the speed of said textile machine, information storage means for storing information as to the movements of each of said plurality of yarns as said yarns are used to produce one piece of said textile goods, said information as to the movements of each of said plurality of yarns constituting a standard pattern, and comparing means for comparing subsequent movements of each of said plurality of yarns during the production of subsequent textile goods, and error means for indicating a difference in a movement of yarn between said standard pattern and each of said subsequent patterns.

2. The combination as claimed in claim 1, and further including means for defining a magin comprising an acceptable difference detected by said comparing means.

3. The combination as claimed in claim 2, said error means including an alarm for providing a perceivable signal.

4. The combination as claimed in claim 2, said error means including stop motion means for stopping the operation of said textile machine.

5. The combination as claimed in claim 2, said textile machine consisting of a knitting machine having a plurality of cams for controlling the operation of said knitting machine, said means for indicating the beginning of a cycle comprising a switch on one cam of said plurality of cams.

6. The combination as claimed in claim 5, said knitting machine further including a shaft rotatable during operation of said knitting machine, said means for producing a signal indicating the speed of said machine comprising means for indicating the speed of rotation of said shaft.

7. A method for monitoring the quality of goods produced by a textile machine, said textile machine being arranged to cause successive movements of each of a plurality of yarns for utilizing said plurality of yarns to produce a piece of textile goods, said successive movements of each of a plurality of yarns being indicative of a particular pattern for said textile goods, said method including the steps of monitoring each movement of each yarn of said plurality of yarns during the production of a first piece of textile goods, and storing said each movement of each yarn of said plurality of yarns, subsequently monitoring each movement of each yarn of said plurality of yarns during the production of a second piece of textile goods, comparing the movement of each yarn with the stored movement and indicating whether or not said movements during the production of said second piece match said movements during the production of said first piece.

8. A method as claimed in claim 7, and further including the step of storing said each movement of each yarn of said plurality of yarns during the production of a second piece of textile goods.

9. A method as claimed in claim 8, and including the steps of comparing the movement of each yarn during the production of a second piece of textile goods with the movement of each yarn during the production of a first piece of textile goods, and indicating whether or not said movements during the production of said second piece match said movements during the production of said first piece.

10. A method as claimed in claim 7, and further including the steps of setting a margin for differences between movements of yarn during production of said first piece and movements of yarn during production of said second piece, and indicating an error when the difference is greater than said margin.

11. A method as claimed in claim 10, and including the step of providing a perceivable alarm when said difference is greater than said margin.

12. A method as claimed in claim 10, and including the step of stopping said textile machine when said difference is greater than said margin.

* * * * *